US007588173B2

(12) United States Patent
Mainetti

(10) Patent No.: US 7,588,173 B2
(45) Date of Patent: Sep. 15, 2009

(54) HANGER WITH METAL HOOK AND INDICATOR BLOCK

(75) Inventor: Mario Mainetti, Valdagno (IT)

(73) Assignee: Mainetti S.p.A., Castelgomberto (Vicenza) (IT)

( * ) Notice: Subject to any disclaimer, the term of this patent is extended or adjusted under 35 U.S.C. 154(b) by 3 days.

(21) Appl. No.: 11/732,074

(22) Filed: Apr. 2, 2007

(65) Prior Publication Data

US 2007/0228089 A1 Oct. 4, 2007

(30) Foreign Application Priority Data

Apr. 13, 2006 (IT) ..... VI06A0111
Jul. 19, 2006 (IT) ..... VI06A0230

(51) Int. Cl.
*A41D 27/22* (2006.01)

(52) U.S. Cl. ..... 223/85; 40/322

(58) Field of Classification Search ..... 223/85, 223/88, DIG. 4; 40/322; D6/328
See application file for complete search history.

(56) References Cited

U.S. PATENT DOCUMENTS

| | | | | | |
|---|---|---|---|---|---|
| 1,634,377 | A | * | 9/1927 | Montan et al. | 40/322 |
| 2,658,627 | A | * | 11/1953 | Magnuson | 211/113 |
| 2,769,587 | A | * | 11/1956 | Clay La | 294/142 |
| 3,024,953 | A | * | 3/1962 | O'Keefe | 223/88 |
| 3,554,418 | A | * | 1/1971 | Holmes | 294/142 |
| 4,123,864 | A | * | 11/1978 | Batts et al. | 40/322 |
| 4,137,661 | A | * | 2/1979 | Johansson | 40/322 |
| 4,288,012 | A | * | 9/1981 | Doak | 294/143 |
| 4,756,104 | A | * | 7/1988 | Bailey | 40/322 |
| 4,863,078 | A | * | 9/1989 | Bengsch | 223/85 |
| 5,778,575 | A | * | 7/1998 | Deupree et al. | 40/322 |
| 6,145,233 | A | * | 11/2000 | Hickmott | 40/673 |
| 6,409,057 | B1 | * | 6/2002 | Kim | 223/85 |
| 6,726,067 | B2 | * | 4/2004 | Louw | 223/85 |
| 7,178,705 | B1 | * | 2/2007 | Sutton | 223/85 |
| 2004/0211796 | A1 | * | 10/2004 | Misumi | 223/85 |
| 2006/0011673 | A1 | * | 1/2006 | Gouldson | 223/85 |

FOREIGN PATENT DOCUMENTS

| | | | | |
|---|---|---|---|---|
| DE | 3306781 | A1 | * | 8/1984 |
| DE | 29510218 | U1 | * | 10/1995 |
| EP | 974295 | A2 | * | 1/2000 |
| FR | 2766601 | A1 | * | 1/1999 |
| GB | 2064472 | A | * | 6/1981 |
| GB | 2140679 | A | * | 12/1984 |
| JP | 08215019 | | * | 8/1996 |
| JP | 10052356 | A | * | 2/1998 |

* cited by examiner

*Primary Examiner*—Gary L Welch
*Assistant Examiner*—Nathan E Durham
(74) *Attorney, Agent, or Firm*—Francis C. Hand; Carella, Byrne, Bain et al.

(57) ABSTRACT

The top portion of a filiform metal hook of a hanger is provided with an eyelet and the indicator block is provided with a protuberance that fits into the eyelet to secure the indicator block on the hook. In one embodiment, the indicator block has two hingedly connected tabs that are snap-fitted together over the mounting portion of the hook. In a second embodiment, the indicator block is of box shape with internal projections that fit into the eyelet of the hook.

6 Claims, 4 Drawing Sheets

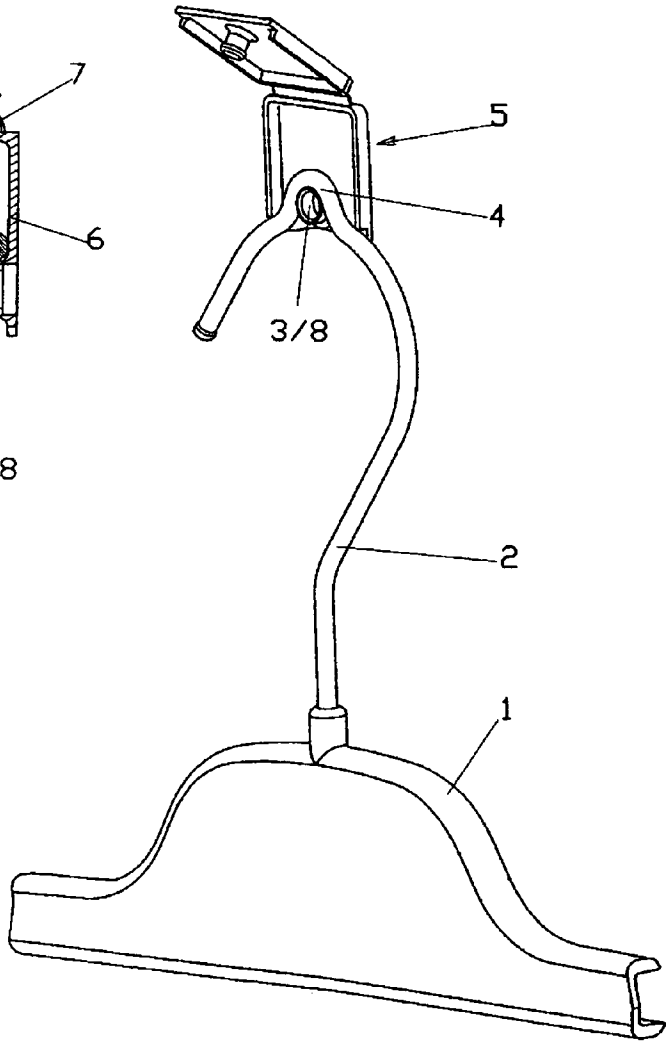
FIG.6
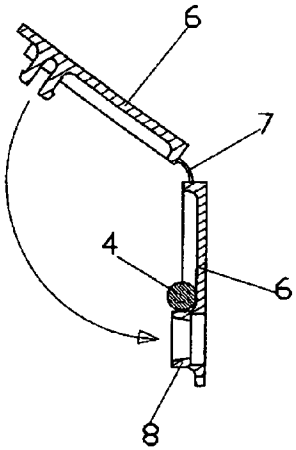
FIG.8
FIG.7
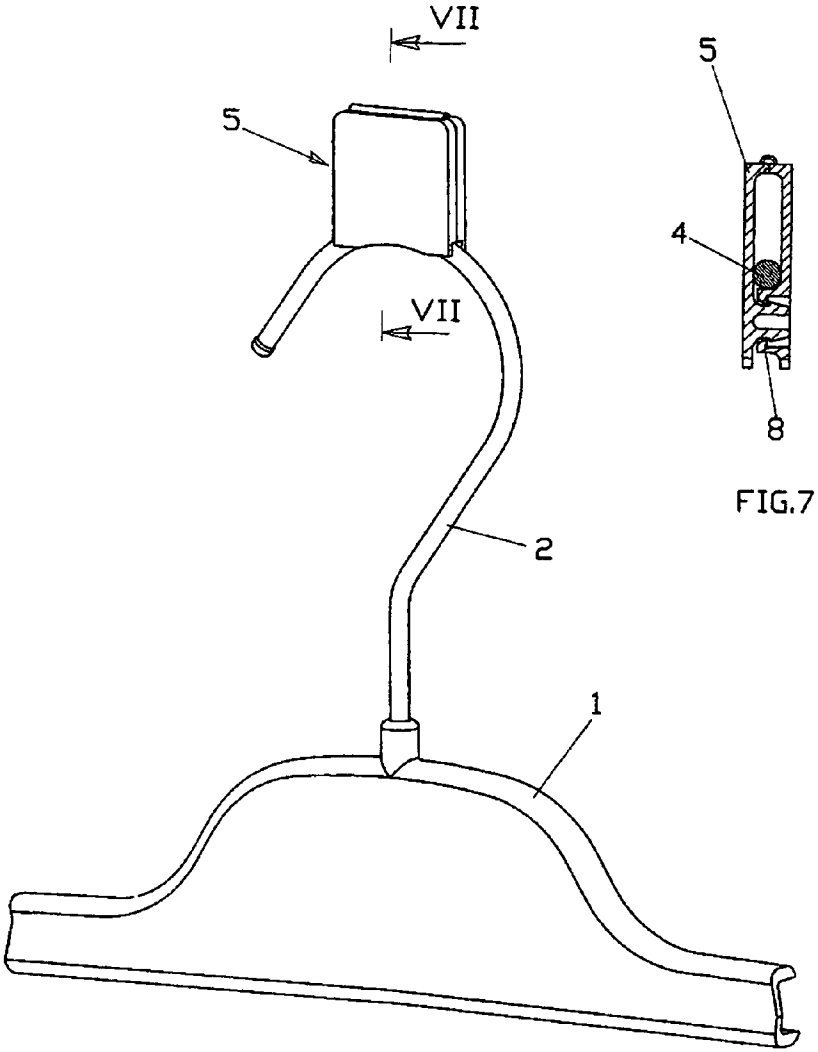
FIG.5

HANGER WITH METAL HOOK AND INDICATOR BLOCK

This invention relates to a hanger with a metal hook and an indicator block.

As is well known, hangers that are used as clothes hangers during warehouse management or in shops for displaying garments are equipped with an indicator block, on which data identifying the garment hung on the hanger is displayed, in particular the size. For this reason, such indicator blocks are commonly identified by the term "size marker".

The most common hangers consist of an arched body, made from plastic or wood, equipped, in a central position, with a filiform metal hook, which is used to hang the hanger on a horizontal bar.

In the current state of the art, indicator blocks, hereafter indicated with the term size marker, normally consist of a body equipped with a through hole, which constitutes a seat for receiving the filiform part of the central hook of the hanger.

In a first well known embodiment, the size marker is equipped with a longitudinal side notch, which allows the size marker to interlock with the filiform body (see, for example, patent document EP-A-1338226), whereas, in a second embodiment, the size marker is slotted and slid through the hook (see, for example, patent document WO-A-2006005467). In both cases, the size marker is always positioned at the base of the hook and rests upon a pawl projecting from the arched body, which pawl has the function of strengthening the union between the two elements, i.e. the hook and body, of the hanger.

In practice, the arrangement of the size markers at the base of the hook is not optimal since, in certain situations, such as a compact grouping together of the hung garments, it is difficult to read the information displayed on the size markers.

Accordingly, it is an object of the invention to provide a hanger having a metal hook with an indicator block or size marker that, when in use, does not have the drawbacks of similar known products.

It is another object of the invention to provide a hanger having a metal hook in which an indicator block or size marker is positioned so as to be clearly visible, in any manner of use of the hanger.

It is another object of the invention to mount a size marker on the top of a metal hook of a hanger to render the size marker clearly visible when several hangers are grouped together on a horizontal bar.

It is another object of the invention to mount a size marker on the top of a metal hook of a hanger in a simple and fast manner.

Briefly, the invention provides a hanger for a garment having a centrally located upstanding metal hook of filiform shape with a mounting portion at a top part of the hook and a separate indicator block on the mounting portion of the hook for displaying data regarding a garment on the hanger.

In accordance with the invention, the top part of the hook is provided with an eyelet onto which the block is anchored so as to project outwards and upwards with respect to the hook and the indicator block is equipped on the inside with one or more projections that, in an operative step, allow the block to be attached to the hook.

In one embodiment, the indicator block includes a pair of tabs that are hingedly secured together, a female protuberance on one of the tabs for fitting under the mounting portion of the hook and a male projection on the other of the tabs for snap-fitting into the protuberance to retain the block on the hook. In addition, the mounting portion of the hook is shaped to define an eyelet and the female protuberance of the block passes through the eyelet.

In another embodiment, the mounting portion of the hook has an arcuate element thereon defining an eyelet and the female protuberance of the block passes through the eyelet.

In still another embodiment, the mounting portion of the hook has a circular element secured thereon to define an eyelet and the female protuberance of the block passes through this eyelet.

In each embodiment, at least one of the tabs of the indicator bock has a pair of oppositely disposed shoulders seated on the hook to maintain the block in an upright vertical manner.

In still another embodiment, the indicator block is in the form of a body of box-shape that has a central passage for sliding of the block over the hook. In this embodiment, the body has a pair of parallel walls located on opposite sides of the hanger hook and each wall has at least one projection disposed under the mounting portion of the hook to retain the block on the hook. In this embodiment, the body of the block is snap-fitted onto the hook via the projections. In addition, the projections face each other and define a frusto-conical channel of decreasing size for passage of the mounting portion of the hook therethrough during mounting of the block on the hook. In this case, the mounting portion of the hook may have a flattened cross-sectional shape to increase the resistance to removal of the block from the hanger hook. Alternatively, each projection may have an inclined surface at an upper end in abutment with the mounting portion of the hook to facilitate removal of the block from the hanger hook.

The indicator block may also include a pair of partitions disposed transversely of and between the walls to abut the hook in order to stabilize the block on the hook in an upright vertical manner.

These and other objects and advantages of the invention will become more apparent from the following detailed description taken in conjunction with the accompanying drawings wherein:

FIG. 5 illustrates a view of a hanger of FIG. 2 with an indicator block constructed in accordance with the invention;

FIG. 6 illustrates a view similar to FIG. 5 during mounting of the indicator block of FIG. 5 in place;

FIG. 7 illustrates a cross-sectional view taken on line VII-VII of FIG. 5;

FIG. 8 illustrates a cross-sectional view similar to FIG. 7 with the indicator block in an opened condition;

Figure 1:
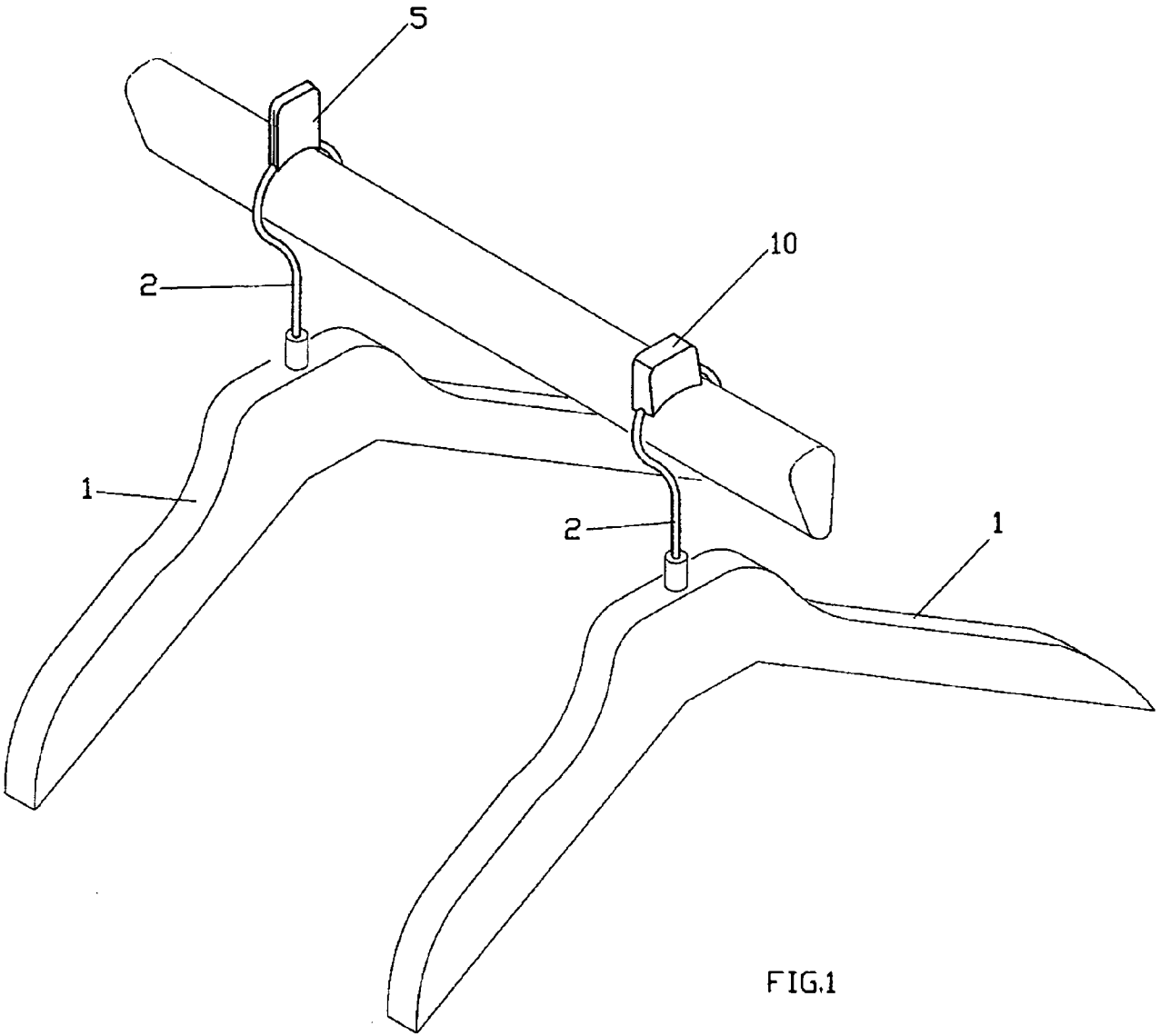
FIG. 1 illustrates a perspective view of two hangers each equipped with an indicator block according to the invention in an operative state.

Referring to FIG. 1, a pair of hangers is shown mounted on a common bar. Each hanger includes an arched body 1 having a metal hook 2 mounted in central position in a conventional manner. In addition, the top of each hanger is provided with an indicator block or size marker 5 or 10, each of which is further described below.

Figures 2, 3, 4:
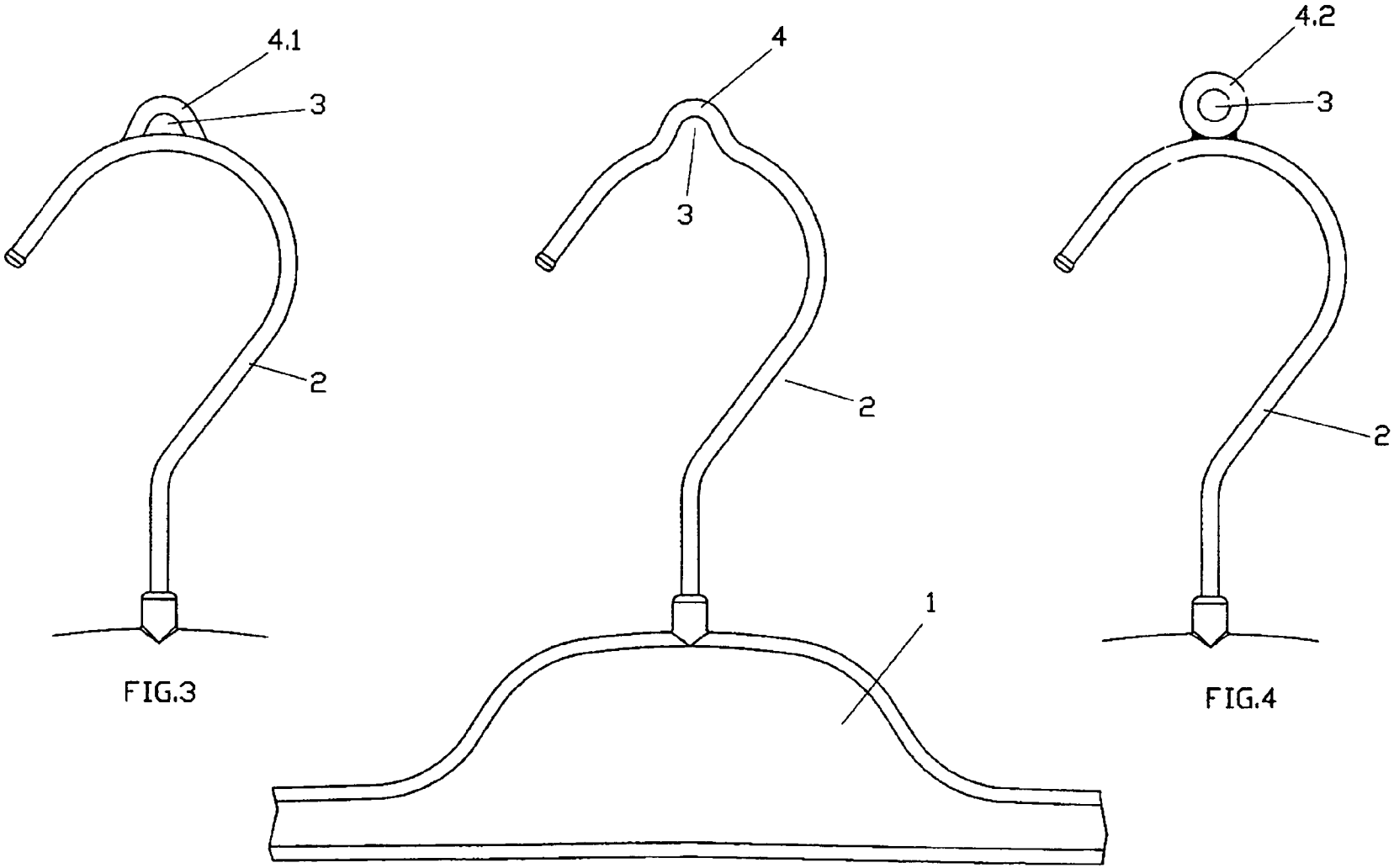
FIG. 2 illustrates a side view of a hanger constructed in accordance with the invention.
FIG. 3 illustrates a side view of a modified hanger constructed in accordance with the invention.
FIG. 4 illustrates a side view of a further modified hanger constructed in accordance with the invention.

Referring to FIG. 2, wherein like reference characters indicate like parts as above, the metal hook of each hanger 1 is centrally located and is of filiform shape with a mounting potion 4 at the top that is shaped to define an eyelet 3. In this respect, the mounting portion 4 of the hook may be shaped by a simple bending operation to form the eyelet. Alternatively, as shown in FIG. 3, an arcuate element 4.1 may be secured, as by welding, gluing or otherwise, to the mounting portion 4 to form the eyelet 3 or, as shown in FIG. 4, a circular element 4.2 may be secured in similar manner to the mounting portion 4 to form an eyelet 3.

Referring to FIGS. 5 to 8, in a first embodiment the indicator block 5 of FIG. 1 consists of two tabs 6 that are hingedly secured together by a flexible strap 7. One tab 6 is provided with a female protuberance 8 for fitting under the mounting portion 4 of the hook (see FIGS. 6 and 8) and the other tab 6 is provided with a male projection (not referenced) for snap-fitting into the protuberance or button 8 (see FIG. 7) to retain the block 5 on the hook 2 (see FIG. 5). The protuberance 8 and projection form a clip fastener. However, any other suitable type of snap-fitting may be used to releasably hold the tabs 6 in a closed position on the hook 2.

As illustrated in FIG. 6, the indicator block 5 consists of a pair of rectangular shaped tabs and an unapertured strap that hingedly secures the tabs together and the female protuberance 8 fits directly under the mounting portion of the hook. In addition, as shown in FIG. 7, the tabs 6 are disposed in parallel on an opposite lateral sides of the mounting portion 4 of the hook 2 and the female protuberance 8 extends perpendicularly of tabs 6 and within the mounting portion 4 of the hook 2.

As illustrated in FIGS. 5 and 7, when the tabs 6 are secured together, the indicator block 5 is fixedly mounted on the mounting portion of the hook 2.

Referring to FIGS. 9 to 12, in a second embodiment the indicator block 10 of Fig. is anchored to the hook 2 through inner projections 13, which engage below the shaped portion 4 of the hook 2.

Figure 11:
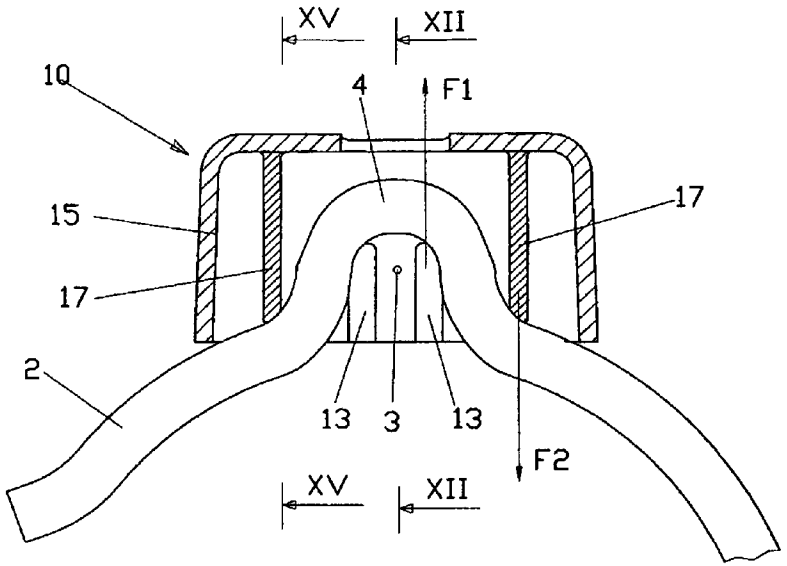
FIG. 11 illustrates a view taken on line XI-XI of FIG. 9.

As can be seen in FIG. 11, the block 10 consists of a body 15, parallelepiped in shape to provide a box-shape with parallel side walls and parallel end walls. As viewed, these walls may be slightly tapered. Also, the block 10 may be provided with an opening in the top surface to provide access to the interior of the block 10.

Figure 10:
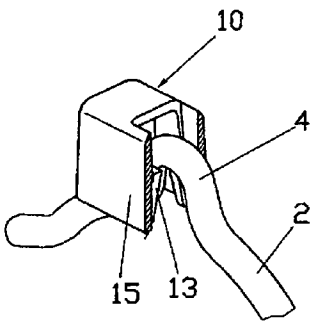
FIG. 10 illustrates a view taken on line X-X of FIG. 9.
Figure 9:
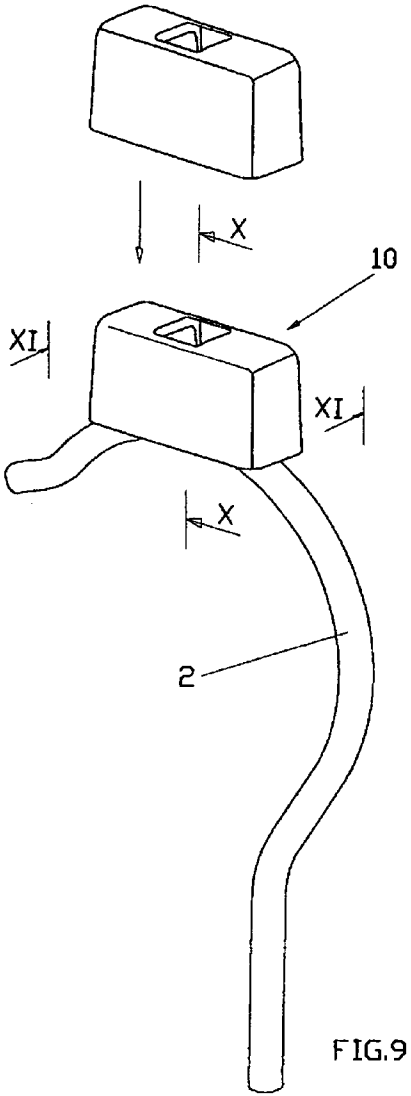
FIG. 9 illustrates a perspective view of a hanger with a modified indicator block of box-shape in accordance with the invention.
Figure 12:
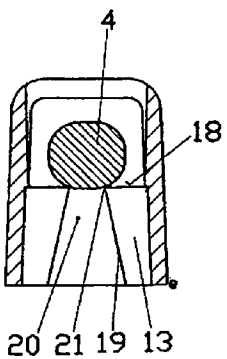
FIG. 12 illustrates a view taken on line XII-XII of FIG. 11.

Referring to FIGS. 10, 11 and 12, each side wall of the body 15 is provided on the inside with a pair of projections 13 that are positioned so that, in an operative step, the projections 13 insert into the eyelet 3 defined by the shaped portion 4 of the filiform body of the hook 2 to retain the body 15 on the hook 2. As shown in FIG. 12, the projections 13 of each side wall face the projections 13 of the opposite wall to define a frusto-conical channel 20 of decreasing size for passage of the mounting portion 4 of the hook 2 therethrough during mounting of the body 15 on the hook 2.

As can be seen in FIG. 12, in a preferred embodiment, the projections 13 have a pointed section, the surfaces 18 and 19 of which define the frusto-conical channel 20 of decreasing width to facilitate, through a slight deformation, insertion of the body 15 onto the hook 2 and a vertex 21, which constitutes a locking point of the body 15 on the hook 2.

Figure 13:
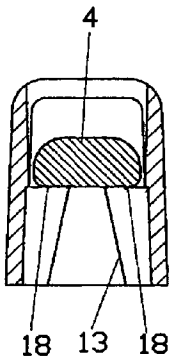
FIG. 13 illustrates a view similar to FIG. 12 with a flattened mounting portion.

As can be seen in FIG. 13, when a substantially strong attachment is required, the cross section of the shaped portion 4 of the hook 2 may be slightly squashed or flattened so that, by widening, this portion 4 rests upon the two top surfaces 18 of the two opposite points. For which reason, at the moment of detachment, the block 10 must undergo a substantial deformation, which therefore requires suitable effort from the operator.

Figure 14:
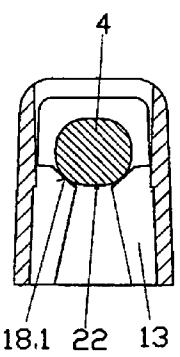
FIG. 14 illustrates a view similar to FIG. 12 projections of the block provided with inclined surfaces at the upper ends.

On the other hand, as can be seen in FIG. 14, when fast detachment with little effort is required, each projection 13 is provided with an inclined surface 18.1 at an upper end in abutment with and tangent to the mounting portion 4 of the hook 2 to form a frusto-conical channel 22 of increasing width in an outward direction to facilitate removal of the block 10 from the hook 2. This feature makes it easier for the block 10 to deform and for the hook 2 to slide during removal.

Figure 15:
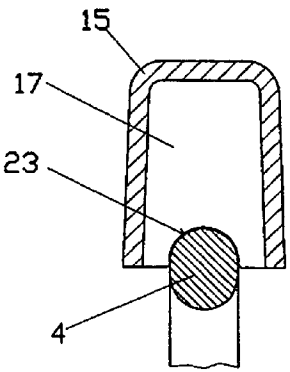
FIG. 15 illustrates a view taken on line XV-XV of FIG. 11.

Referring to FIGS. 11 and 15, the body 15 is also provided with a pair of partitions or thin walls 17 that are integrally disposed transversely to and between the side walls. The partition walls are disposed on opposite sides of the mounting portion 4 of the hook 2 to maintain the block 10 in an upright vertical manner (see FIG. 11) and each partition wall 17 has a recess 23 in a lower end disposed in abutment with the hook 2 (see FIG. 15).

As can be seen in FIG. 15, the thin walls 17 rest upon the hook 2, with an extended shaped portion 23 and this gives a substantial stability of the block 10 on the hook 2, since it is thus held in position by the combined action of the opposite pushes generated, respectively, by the projections 13 and by the walls 17 (see arrows of FIG. 11).

Due to the box-shape, the indicator block 10 is very strong and easy to insert onto the filiform body of the hook 2 and, due to the parallelepiped configuration, the block has an extensive side surface, which allows a large amount of information regarding a hung garment to be displayed, through incision, smooth or raised stamping with hot press, pad printing or with other methods, in addition to the size, also, for example an advertising logo or other useful indications.

Basically, from what has been outlined above and as can be worked out from observing the Figs., the indicator blocks described above, to be applied onto the substantially top part of the hook, substantially differ from the known blocks.

Of course, embodiments that are even substantially different from the ones described are also possible, both in terms of the configurations of the eyelet 3, and in terms of the type of indicator block 5,10 used, without, for this reason, departing from the scope of the following claims.

What is claimed is:

1. In combination a hanger for a garment having a centrally located upstanding metal hook of filiform shape, said hook having a mounting portion at a top part thereof shaped to define an eyelet; and a separate indicator block for displaying data regarding a garment on said hanger, said block being mounted on said mounting portion of said hook; said block including a body of box-shape having a pair of parallel walls on opposite sides of said hook, each said wall having at least one projection thereon facing the other of said walls and disposed under said mounting portion of said hook to retain said block on said hook, a pair of partitions secured transversely to and between said walls, each said partition having a recess in a lower end disposed in abutment with said hook on opposite sides of said mounting portion of said hook to maintain said block in an upright vertical manner.

2. The combination as set forth in claim 1 wherein said projection of each said wall faces said projection of the other of said pair of parallel walls to define a frusto-conical channel of decreasing size for passage of said mounting portion of said hook therethrough during mounting of said block on said hook.

3. The combination as set forth in claim 2 wherein said mounting portion of said hook has a flattened cross-sectional shape.

4. The combination as set forth in claim 2 wherein each said projection has an inclined surface at an upper end in abutment with said mounting portion of said hook to facilitate removal of said block from said hook.

5. An indicator block for displaying data regarding a garment on a hanger having an upstanding metal hook of filiform shape with, a mounting portion at a top thereof, said block including a body of box-shape having a pair of parallel walls on opposite sides thereof and an opening in a top surface to provide access to an interior of said block;

at least one projection on each of said walls in facing relation to a projection on the other of said walls for disposition under the mounting portion of the hook to retain said body on the hook, said projections defining a frusto-conical channel of decreasing size for passage of the mounting portion of the hook therethrough during mounting of said body on the hook; and a pair of integral partitions disposed transversely to and between said walls, each said partition having a recess in a lower end for abutment with the hook to maintain said body in an upright vertical manner.

6. An indicator block as set forth in claim 5 wherein each said projection has an inclined surface at an upper end for abutment with the mounting portion of the hook to facilitate removal of said body from the hook.

* * * * *